US010469954B1

(12) United States Patent
Cheng et al.

(10) Patent No.: US 10,469,954 B1
(45) Date of Patent: Nov. 5, 2019

(54) THIN SPEAKER WITH A VOICE COIL HAVING A DAMPER FUNCTION

(71) Applicant: ZYLUX ACOUSTIC CORPORATION, Taipei (TW)

(72) Inventors: Sheng Yueh Cheng, Taipei (TW); Wang Ting Tsai, Taipei (TW); Bo Feng Chen, Taipei (TW)

(73) Assignee: ZYLUX ACOUSTIC CORPORATION, Taipei (TW)

( * ) Notice: Subject to any disclaimer, the term of this patent is extended or adjusted under 35 U.S.C. 154(b) by 0 days.

(21) Appl. No.: 16/252,751

(22) Filed: Jan. 21, 2019

(51) Int. Cl.

| | |
|---|---|
| ***H04R 9/06*** | (2006.01) |
| ***H04R 9/02*** | (2006.01) |
| ***H04R 7/12*** | (2006.01) |
| ***H04R 9/04*** | (2006.01) |
| ***H04R 7/18*** | (2006.01) |

(52) U.S. Cl.
CPC ..... *H04R 9/06* (2013.01); *H04R 7/12* (2013.01); *H04R 7/18* (2013.01); *H04R 9/025* (2013.01); *H04R 9/043* (2013.01); *H04R 9/046* (2013.01); *H04R 9/047* (2013.01); *H04R 2231/003* (2013.01); *H04R 2400/11* (2013.01)

(58) Field of Classification Search
CPC ... H04R 7/04; H04R 7/18; H04R 7/20; H04R 9/025; H04R 9/043; H04R 9/047; H04R 9/06; H04R 2207/021; H04R 2231/003; H04R 2400/11
USPC ..... 381/398, 399, 403, 404, 405, 408, 409, 381/410, 431
See application file for complete search history.

(56) References Cited

U.S. PATENT DOCUMENTS

| | | | | |
|---|---|---|---|---|
| 3,873,784 A * | 3/1975 | Doschek | H04R 9/025 | 381/186 |
| 4,228,327 A * | 10/1980 | Sawafuji | H04R 7/20 | 381/398 |
| 4,491,698 A * | 1/1985 | Larson | H04R 7/04 | 381/408 |
| 5,664,024 A * | 9/1997 | Furuta | H04R 7/127 | 381/396 |
| 7,254,248 B2 * | 8/2007 | Johannsen | H04M 1/03 | 381/409 |

* cited by examiner

*Primary Examiner* — Huyen D Le
(74) *Attorney, Agent, or Firm* — Lin & Associates Intellectual Property, Inc.

(57) ABSTRACT

A thin speaker with a voice coil having a damper function, includes a frame, a magnetic device, a damper voice coil and a diaphragm. The damper voice coil comprises a holding member and a conductive member. The holding member includes a holding base and two holding suspension portions formed on two ends of the holding base. The conductive member includes a conductor wound to form a first winding at one side of the holding base and a second winding at the other side of the holding base, and two conductive suspension portions formed on two ends of the conductor and located on the top of holding suspension portions. Since the damper voice coil has the functions of a damper and a voice coil, the present invention is capable of maintaining a thin design and ensuring the up and down movements of the holding base to prevent its deflection.

10 Claims, 15 Drawing Sheets

THIN SPEAKER WITH A VOICE COIL HAVING A DAMPER FUNCTION

BACKGROUND OF THE INVENTION

1. Field of the Invention

The present invention relates generally to a speaker, and more particularly, to a thin speaker with a voice coil having a damper function.

2. The Prior Arts

Referring to FIG. 1, which is a schematic view of a conventional thin speaker. The conventional thin speaker 100 includes a frame (not shown), a magnetic device 102, a voice coil 103, and a diaphragm 104. The magnetic device 102 is disposed within the frame and includes a seat 1021, three pieces of magnets 1022, 1023, 1024 and three pieces of magnetic metals 1025, 1026, 1027. The seat 1021 is constituted by magnetic conductive metals. The magnets 1022, 1023, 1024 are provided at the top of the seat 1021 and are spaced apart with each other. The conductive metals 1025, 1026, 1027 are disposed on the top of the magnets 1022, 1023, 1024, respectively. The voice coil 103 includes a duct 1031 and a wire 1032. The duct 1031 is disposed at a space between an outer side of the magnet 1023 at the middle and an inner side of the magnets 1022, 1024 at two sides to surround the magnet 1023. The wire 1032 winds around the duct 1031 at its outer peripheral surface to form a winding 1033. The diaphragm 104 is provided on the top of the voice coil 103, and the bottom of the diaphragm 104 abuts against the top of the duct 1031 of the voice coil 103.

The working principle of the conventional thin speaker 100 is as following: an electromagnetic field is generated when electric current flows through the winding 1033 of the voice coil 103; such electromagnetic field is perpendicular to a fixed magnetic field provided by the magnetic device 102 and generates an attraction or a repulsion, causing the duct 1031 of the voice coil 103 to perform a vertical reciprocating motion to move up and down within the magnetic device 102, and driving the diaphragm 104 to perform a vertical reciprocating motion to move up and down (i.e. vibration); thereby, air is vibrated to produce audio sounds to human ears for listening, thereby achieving a transformation from electrical energy to acoustic energy.

A high capacity thin speaker 100 requires an additional connection by lead wire (not shown), such that the thin speaker 100 is capable of continuously sending signals to the wire 1032 in cases when it is vibrated with great amplitude.

However, the conventional thin speaker 100 omits the use of damper for its thin design. As a result, in cases where vibrating amplitude is high, such as in cases of high volume and low frequency, the voice coil 103 is easily deflected during the reciprocating motion, causing a high distortion rate of the conventional thin speaker 100.

Besides, the conventional thin speaker 100 has an edge with a great compliance, such that two ends of the wire 1032 become suspended after they are connected with two terminals. If two ends of the wire 1032 connect with additionally lead wires, the lead wires are also suspended. In long term, the wire 1032 or the lead wires can be readily fractured. Moreover, an inappropriate design or assembly, or abnormal pulling of the wire 1032 readily cause unbalanced vibration of the voice coil 103, making the sound generated by the diaphragm 104 to be distorted. Furthermore, low structural strength of the wire 1032 is also a reason of fracture, yet the addition of lead wires would reduce sound pressure. Based on the reasons above, the conventional thin speaker 100 is incapable of withstanding high output capacity, easy to become exhausted, and produces low quality of sounds.

In addition, the wire 1032 of the voice coil 103 in general is constituted by a copper conductor 10321 covered by an insulation layer 10322, such as an enameled wire. As shown in FIG. 1, the cross section of the copper conductor 10321 is usually a circular shape, and the cross section of the insulation layer 10322 is an annular shape. Thus, the insulation layers 10322 are contacted with each other by points, resulting in large gaps between the wires 1032. The conductor area is therefore small, resulting in more magnetic leakage and less magnetic flux; thereby, the thin speaker 100 losses a lot of capacity and is distorted in tones of high and low frequency.

Furthermore, the conventional thin speaker 100 is restricted by the shape of the voice coil 103. When the conventional thin speaker 100 is long in dimension, it is required to utilize multiple sets of the magnetic devices 102, which increases the overall weight.

SUMMARY OF THE INVENTION

A main objective of the present invention is to provide a thin speaker with a voice coil having a damper function, by which a thin-typed designed is maintained, and in cases where the vibrating amplitude is high, such as in cases of high volume and low frequency, the voice coil is ensured to perform its reciprocating motion to move up and down and prevented from deflection, thereby reducing the distortion rate.

A second objective of the present invention is to provide a thin speaker with a voice coil having a damper function, by which the power rating is greatly increased, the vibration system is maintained balanced and distortion is efficiently reduced, thereby improving quality of sounds.

A third objective of the present invention is to provide a thin speaker with a voice coil having a damper function, in which the conductor is designed to contact with the insulation layers by faces without gaps, the conductor area is increased and therefore has a higher magnetic flux, thereby efficiently achieving sound effect output with high efficiency and low magnetic leakage to improve optimal performance of the present invention.

A forth objective of the present invention is to provide a thin speaker with a voice coil having a damper function, in which the structure of the voice coil is thinned such that the magnetic device can be designed to include two magnetic sets, the frame can be decreased in volume and length to accommodate the magnetic device and the voice coil, thereby reducing the volume and weight of the present invention to be in line with consumers' demand of a light, short, thin, and small speaker.

In order to achieve the above-mentioned objectives, the present invention provides a thin speaker with a voice coil having a damper function, comprising a frame, a magnetic device, a damper voice coil and a diaphragm. The frame is configured to surround and define a chamber. The magnetic device is disposed inside the chamber. The damper voice coil is disposed inside the chamber, the damper voice coil comprises a holding member and a conductive member, the holding member includes a holding base and two holding suspension portions, the holding base is disposed inside the magnetic device, the two holding suspension portions are respectively integrally formed on two ends of the holding base, each of the holding suspension portions is provided with a perforation, the conductive member includes a conductor and two conductive suspension portions, the conductor is wound to form a first winding at one side of the holding base and a second winding at the other side of the holding base, the two conductive suspension portions are respectively integrally formed on two ends of the conductor, the conductive suspension portions are located on the top of the holding suspension portions, the shape of the conductive suspension portions are corresponding to the shape of the holding suspension portions, and at least a part of each of the conductive suspension portions is exposed from the perforations of the holding suspension portions. The diaphragm is disposed on the top of the damper voice coil, and the bottom of the diaphragm is abutting against the top of the damper voice coil.

Preferably, the damper voice coil comprises a first clamping member and a second clamping member; the first clamping member includes a first clamping base and two first clamping suspension portions, the two first clamping suspension portions are respectively integrally formed on two ends of the first clamping base; the second clamping member includes a second clamping base and two second clamping suspension portions, the two second clamping suspension portions are respectively integrally formed on two ends of the second clamping base; the first clamping base and the second clamping base together clamp a combination of the holding base and the conductor; the first clamping suspension portions are corresponding to the holding suspension portions in shape, and the second clamping suspension portions are corresponding to the holding suspension portions in shape; one of the first clamping suspension portions and one of the second clamping suspension portions together clamp a combination of one of the holding suspension portions and one of the conductive suspension portions, wherein said one of the second clamping suspension portions contacts an inner side wall of the chamber of the frame; the other one of the first clamping suspension portions and the other one of the second clamping suspension portions together clamp a combination of the other one of the holding suspension portions and the other one of the conductive suspension portions, wherein said other one of first clamping suspension portions contacts the inner side wall of the chamber of the frame; said one of the first clamping suspension portions is provided with an opening hole which is communicated with the perforation of said one of the holding suspension portions, such that at least a part of said one of the conductive suspension portions is exposed from the opening hole of said one of the first clamping suspension portions and the perforation of said one of the holding suspension portions; and said other one of the second clamping suspension portions is provided with an opening hole which is communicated with the perforation of said other one of the holding suspension portions, such that at least a part of said other one of the conductive suspension portions is exposed from the opening hole of said other one of the second clamping suspension portions and the perforation of said other one of the holding suspension portions.

Preferably, the two holding suspension portions have a same shape and are perpendicular to the holding base, the two first clamping suspension portions have a same shape and are perpendicular to the first clamping base, and the two second clamping suspension portions have a same shape and are perpendicular to the second clamping base.

Preferably, each of the holding suspension portions has a first U-shaped segment and a second U-shaped segment; the two first U-shaped segments of the holding suspension portions are respectively integrally formed on two ends of the holding base, and are respectively located at two sides of the holding base; the two second U-shaped segments of the holding suspension portions are respectively integrally formed on two other ends of the first U-shaped segments of the holding suspension portions, and are respectively located at two sides of the holding base; and the first U-shaped segment and the second U-shaped segment of each of the holding suspension portions are located at two different sides of the holding base and are opened in opposite directions; wherein, each of the conductive suspension portions has a first U-shaped segment and a second U-shaped segment; the two first U-shaped segments of the conductive suspension portions are respectively integrally formed on two ends of the conductor, and are respectively located at an external side of the first winding and an external side of the second winding; the two second U-shaped segments of the conductive suspension portions are respectively integrally formed on two other ends of the first U-shaped segments of the conductive suspension portions, and are respectively located at the external side of the first winding and the external side of the second winding; the first U-shaped segment and the second U-shaped segment of said one of the conductive suspension portions are respectively located at the external side of the first winding and the external side of the second winding, the first U-shaped segment and the second U-shaped segment of said other one of the conductive suspension portions are respectively located at the external side of the second winding and the external side of the first winding; and the first U-shaped segment and the second U-shaped segment of each of the conductive suspension portions are opened in opposite directions; wherein, each of the first clamping suspension portions has a first U-shaped segment and a second U-shaped segment; the two first U-shaped segments of the first clamping suspension portions are respectively integrally formed on two ends of the first clamping base, and are respectively located at two sides of the first clamping base; the two second U-shaped segments of the first clamping suspension portions are respectively integrally formed on two other ends of the first U-shaped segments of the first clamping suspension portions, and are respectively located at two sides of the first clamping base; and the first U-shaped segment and the second U-shaped segment of each of the first clamping suspension portions are located at two different sides of the first clamping base and are opened in opposite directions; and wherein, each of the second clamping suspension portions has a first U-shaped segment and a second U-shaped segment; the two first U-shaped segments of the second clamping suspension portions are respectively integrally formed on two ends of the second clamping base, and are respectively located at two sides of the second clamping base; the two second U-shaped segments of the second clamping suspension portions are respectively integrally formed on two other ends of the first U-shaped segments of the second clamping suspension portions, and are respectively located at two sides of the second clamping base; and the first U-shaped segment and the second U-shaped segment of each of the second clamping suspension portions are respectively located at two different sides of the second clamping base and are opened in opposite directions.

Preferably, each of the holding suspension portions is provided with the perforation at one end; said one of the first clamping suspension portions is provided with the opening hole at one end, and said other one of the second clamping suspension portions is provided with the opening hole at one end.

Preferably, the holding member, the first clamping member and the second clamping member are flexible printed circuits; and the conductor is printed and wound on two sides of the holding base to form the first winding and the second winding.

Preferably, the holding base is provided with a through hole, the through hole penetrates from one side of the holding base to the other side of the holding base; and the conductor passes through the through hole from one side of the holding base and extends to the other side of the holding base, the conductor is wound from inside to outside of the through hole to form the first winding on one side of the holding base and the second winding on the other side of the holding base.

Preferably, connection points between the two conductive suspension portions and two ends of the conductor are bent to become two positioning plates, the positioning plates respectively abut against two sides of the holding base.

Preferably, the magnetic device includes two magnet sets, the magnet sets are spaced apart with each other, each of the magnet sets includes a magnet and two magnetic metals, the magnet is disposed between the two magnetic metals, and the damper voice coil is located at a gap between the two magnet sets.

Preferably, the conductor has a rectangular cross-section; and an insulation layer is filled between two adjacent laps of the conductor of the first winding, and an insulation layer is filled between two adjacent laps of the conductor of the second winding.

The present invention is beneficial with the following effects: since the damper voice coil has the functions of a damper and a voice coil at the same time, a thin-typed designed is maintained, and in cases where the vibrating amplitude is high, such as in cases of high volume and low frequency, the damper voice coil is ensured to perform its reciprocating motion to move up and down and prevented from deflection, thereby reducing the distortion rate.

In addition, since the two conductive suspension portions are supported by the two holding suspension portions, it is unlikely for them to contact with other components, thereby preventing production of abnormal sounds. In addition, since the two conductive suspension portions have excellent structural strength that are not easily to be fractured, the present invention only requires to determine the parameter of withstand current of the conductor and can be applied on an open frame (speaker box). Thus, the damper voice coil is capable of significantly improving the power rating, maintaining balance of the vibration system (i.e. the combination of the holding base and the conductor, and the diaphragm), thereby reducing distortion rate to improve quality of sounds.

Besides, each lap of the conductor is designed to contact with the insulation layers by faces without gaps, the conductor area is increased and therefore has a higher magnetic flux, thereby efficiently achieving sound effect output with high efficiency and low magnetic leakage to improve optimal performance of the present invention.

Furthermore, since the structure of the damper voice coil is thinned such that the magnetic device can be designed to include only two magnetic sets, the frame can therefore be decreased in volume and length to accommodate the magnetic device and the damper voice coil, thereby reducing the volume and weight of the present invention to be in line with consumers' demand of a light, short, thin, and small speaker.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
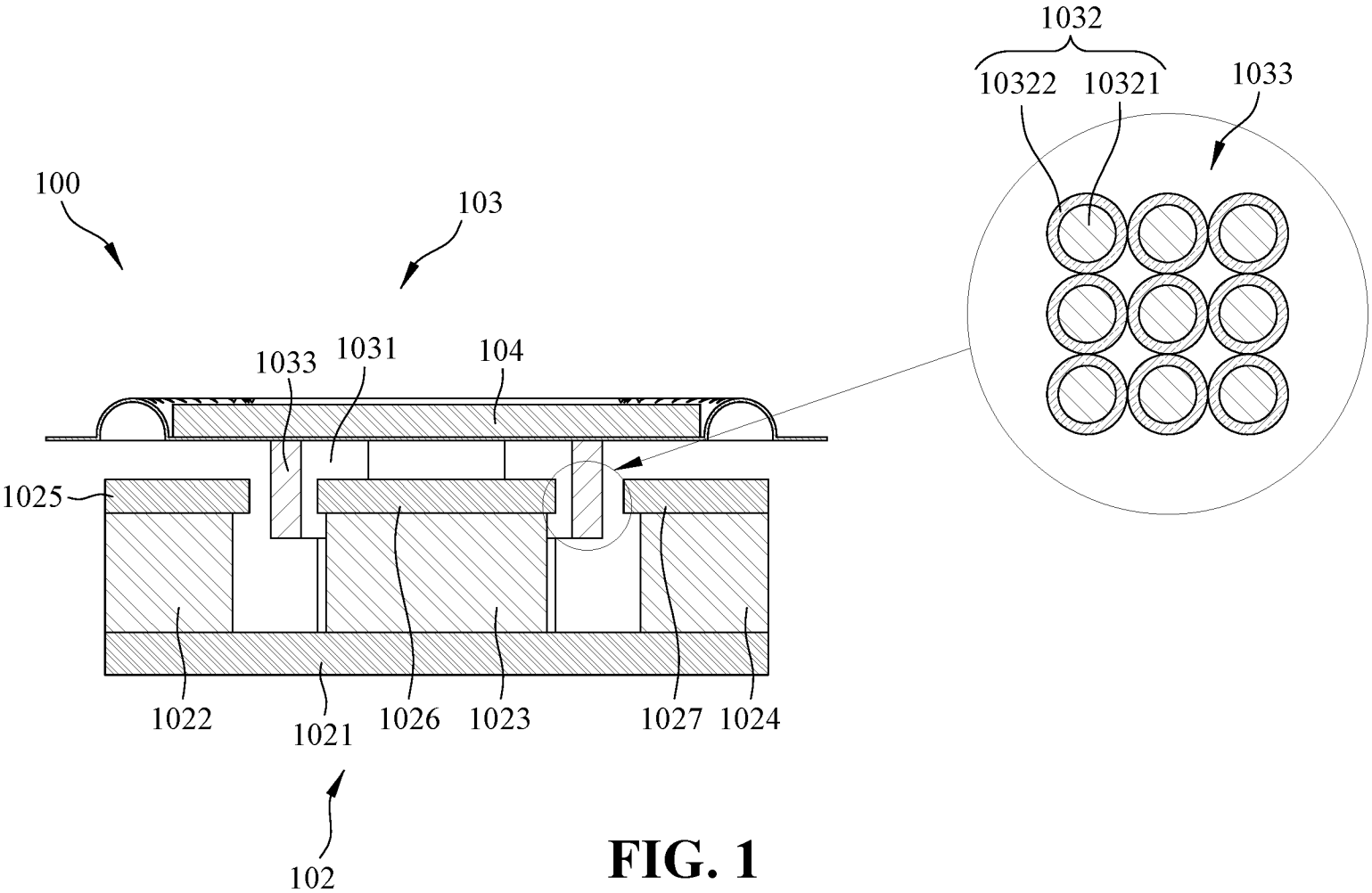
FIG. 1 (PRIOR ART)
FIG. 1 is a schematic view of the conventional thin speaker.

The embodiments of the present invention will be described in more detail below with reference to the drawings and the reference numerals, such that the invention can be implemented by those skilled in the art after studying this specification.

Figure 2:
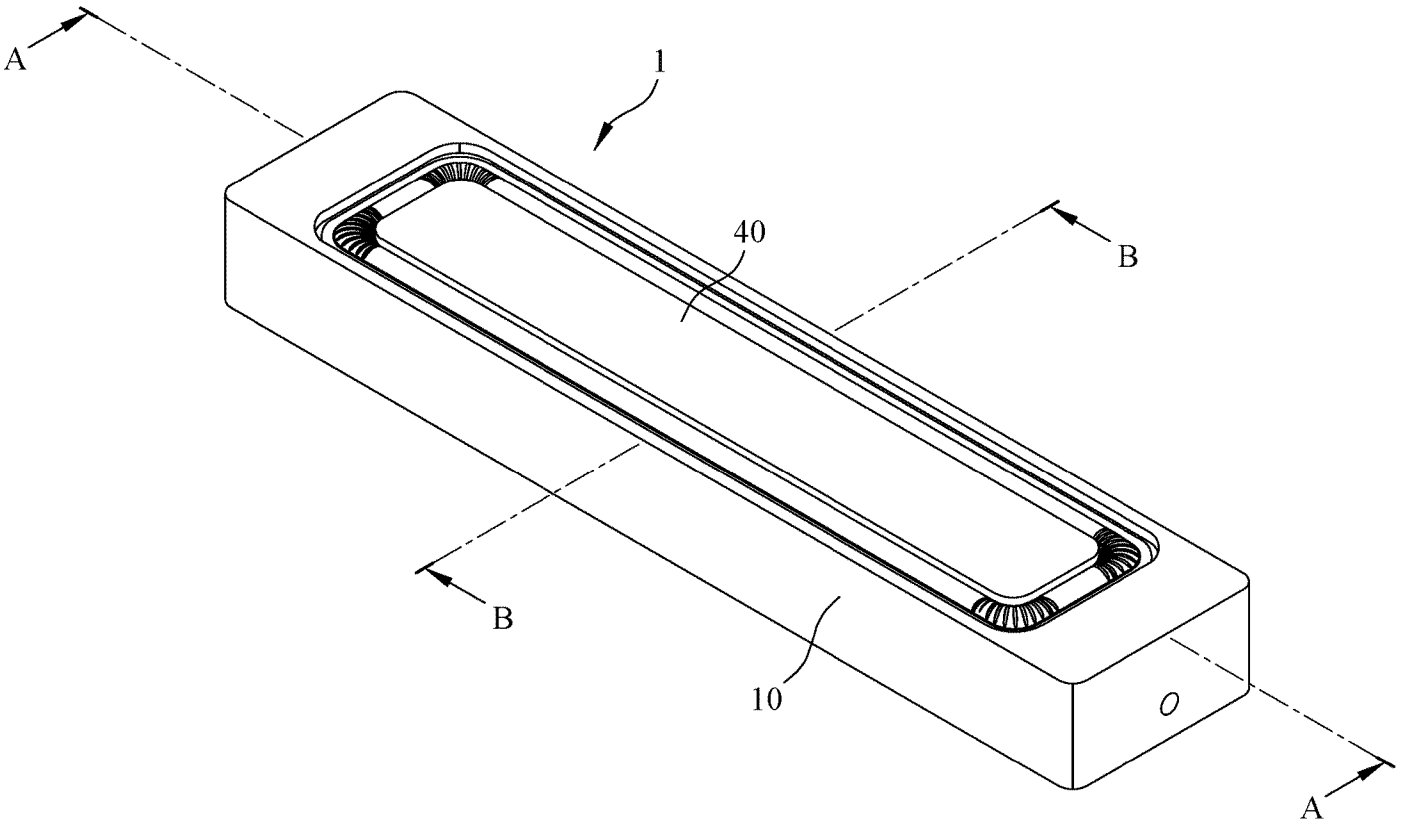
FIG. 2 is a perspective view of the present invention.
Figure 3:
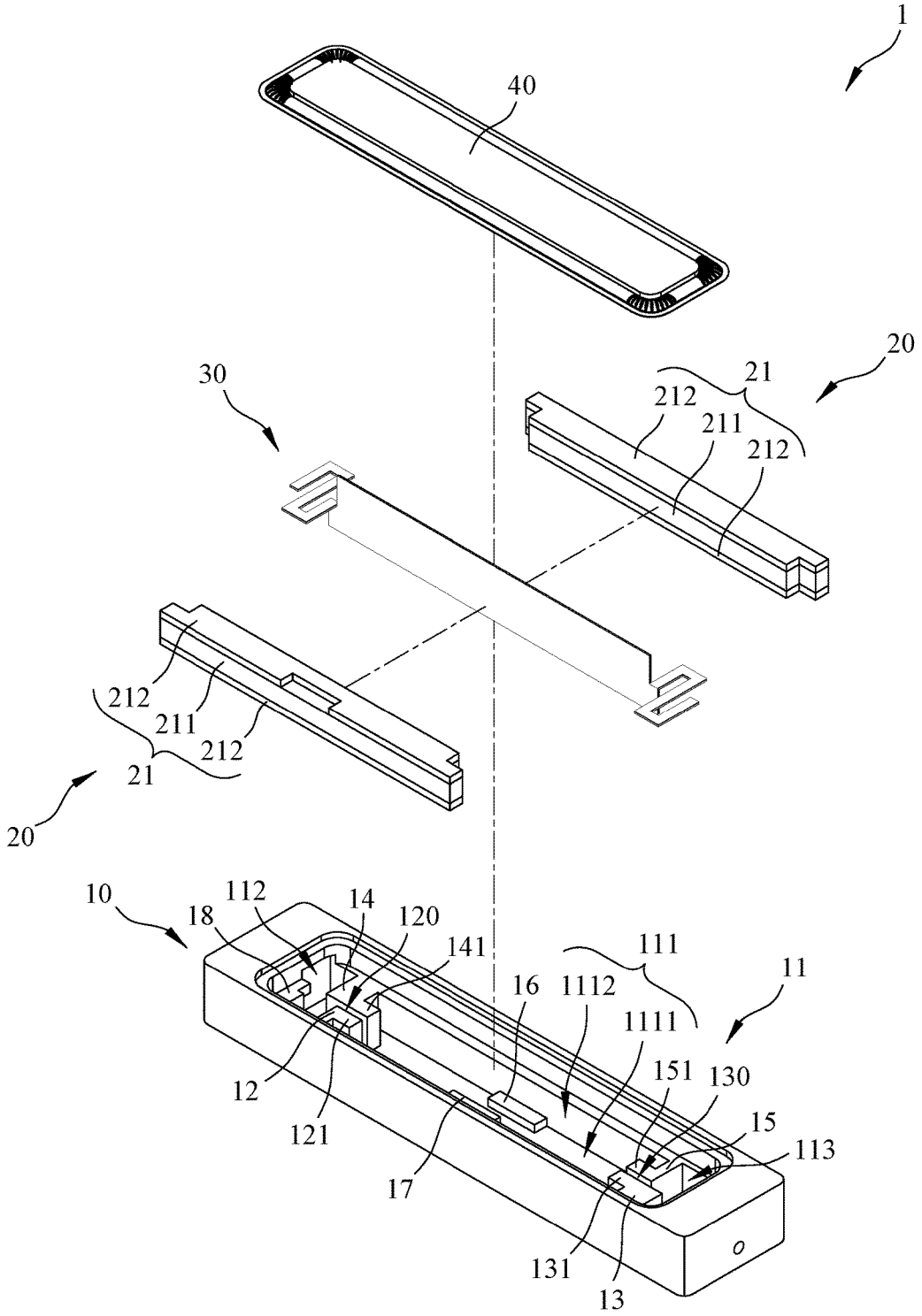
FIG. 3 is an exploded view of the present invention.
Figure 4:
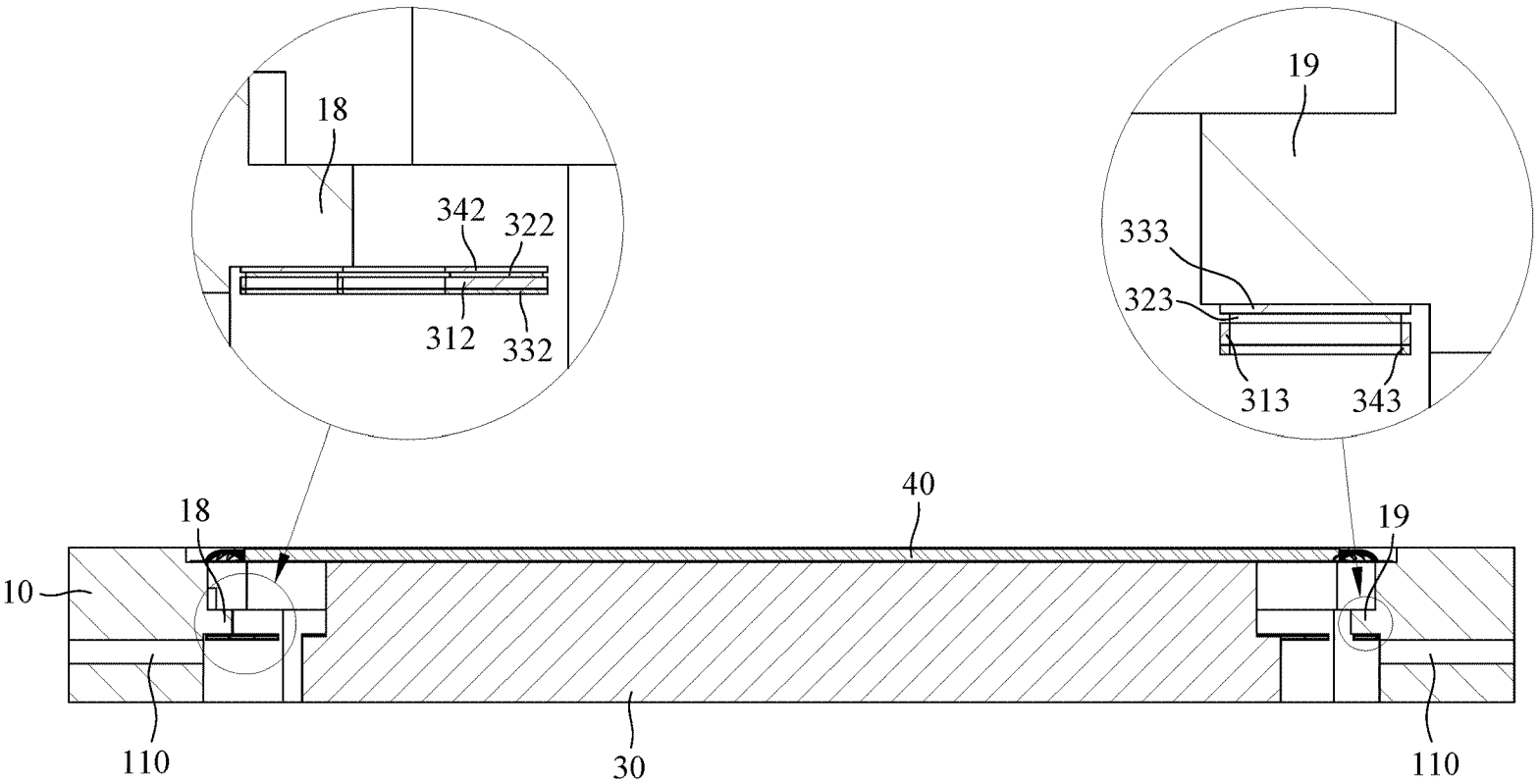
FIG. 4 is a cross-sectional view taken along line A-A of FIG. 2.
Figure 5:
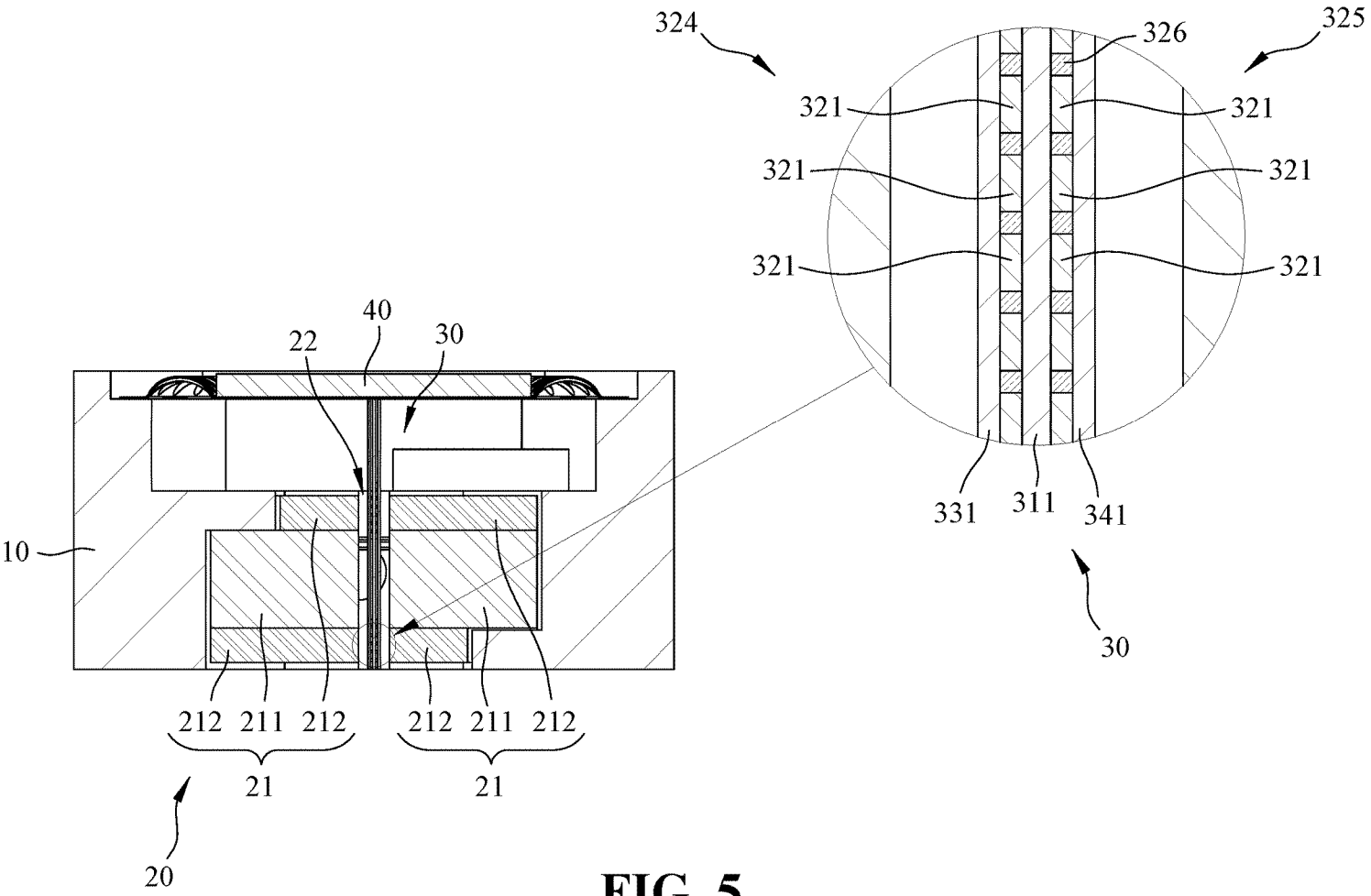
FIG. 5 is a cross-sectional view taken along line B-B of FIG. 2.

Referring to FIGS. 2 to 5, in which FIG. 2 is a perspective view of the present invention, FIG. 3 is an exploded view of the present invention, FIG. 4 is a cross-sectional view taken along line A-A of FIG. 2, and FIG. 5 is a cross-sectional view taken along line B-B of FIG. 2. The present invention provides a thin speaker 1 with a voice coil having a damper function, comprising a frame 10, a magnetic device 20, a damper voice coil 30, and a diaphragm 40. The frame 10 surrounds and defines a chamber 11. The magnetic device 20 and the damper voice coil 30 are both provided in the chamber 11. The diaphragm 40 is provided above the damper voice coil 30 and the bottom of the diaphragm 40 abuts against the top of the damper voice coil 30.

Referring to FIGS. 6 to 13, the damper voice coil 30 includes a holding member 31 and a conductive member 32. The holding member 31 includes a holding base 311 and two holding suspension portions 312, 313. The holding base 311 is provided within the magnetic device 20. The two holding suspension portions 312 and 313 are integrally formed on two ends of the holding base 311, respectively, and are provided with perforations 314 and 315, respectively. The conductive member 32 includes a conductor 321 and two conductive suspension portions 322, 323. The conductor 321 is wound to form a first winding 324 on one side of the holding base 311 and a second winding 325 on the other side of the holding base 311. The two conductive suspension portions 322 and 323 are integrally formed on two ends of the conductor 321, respectively, and are located on the top of the two holding suspension portions 312 and 313, respectively. The shape of the two conductive suspension portions 322, 323 are respectively corresponding to the shape of the two holding suspension portions 312, 313. The conductive suspension portion 322 has at least a part exposing from the perforation 314 of the holding suspension portion 312, and the conductive suspension portion 323 has at least a part exposing from the perforation 315 of the holding suspension portion 313.

One terminal (not shown) passes through one end of the frame 10 and the perforation 314 of the holding suspension portion 312, and connects to the conductive suspension portion 322, and the other terminal (not shown) passes through the other end of the frame 10 and the perforation 315 of the holding suspension portion 313, and connects to the conductive suspension portion 323. Electric current is induced to the first winding 324 and the second winding 325 through the two conductive suspension portions 322, 323 from the two terminals and generates an electromagnetic field which is perpendicular to a fixed magnetic field of the magnetic device 20 to trigger attraction and repulsion. At this time, an electrodynamic force in a direction following the left-hand rule is applied to the holding base 311. When the force is applied, the holding base 311 begins a vertical reciprocating motion to move up and down within the magnetic device 20 and drives the diaphragm 40 to produce a vertical reciprocating motion to move up and down (i.e. vibration). As a result, the air is vibrated to produce audio sounds to human ears for listening, thereby achieving a transformation from electrical energy to acoustic energy.

It is important to note that the two holding suspension portions 312, 313 can be used as a damper and possess the following beneficial effects: first, holding the holding base 311 at a correct position within the magnetic device 20; second, ensuring the holding base 311 stably perform the vertical reciprocating motion to move up and down along an axial direction when force is applied; third, determining the resonance frequency of the present invention together with the holding base 311 and the diaphragm 40; and fourth, supporting the conductive suspension portions 322, 323. As the damper voice coil 30 possesses the functions of a damper and of a voice coil at the same time, the present invention is capable of maintaining a conventional thin design, ensuring the up and down movements of the holding base 311 during its reciprocating motion in cases where the vibrating amplitude is high, such as in cases of high volume and low frequency etc., and preventing deflection, thereby reducing distortion rate.

Besides, since the two conductive suspension portions 322, 323 are supported by the two holding suspension portions 312, 313, it is unlikely for them to contact with other components, thereby preventing production of abnormal sounds. In addition, since the two conductive suspension portions 322, 323 have excellent structural strength that are not easily to be fractured, the present invention only requires to determine the parameter of withstand current of the conductor 321 and can be applied on an open frame 10 (speaker box). Thus, the damper voice coil 30 is capable of significantly improving the power rating, maintaining balance of the vibration system (i.e. the combination of the holding base 311 and the conductor 321, and the diaphragm 40), thereby reducing distortion rate to improve quality of sounds.

In particular, in the present embodiment, the holding member 31 is a flexible printed circuit (FPC). The conductor 321 can be printed on two sides of the holding base 311 as circuit arrangement and wound to form a first winding 324 and a second winding 325, such that the conductor 321 is provided as signal transmission medium. Since FPC is characterized with continuous automated production, increased wiring density, lighter weight, smaller size, reduced wiring errors, flexibility and changeable in shape etc., it is suitable for use in the present invention. In other embodiments, materials of non-flexible printed circuits can be used as the holding member 31. The present invention uses copper as the material of the conductor 321; thus, the conductor 321 in the present invention is a copper conductor, but is not limited thereto. The conductive suspension portions 322, 323 also use copper as material, and the copper is 0.05 mm in thickness; thus, the conductive suspension portions 322, 323 are copper foils, but not limited thereto.

Figure 10:
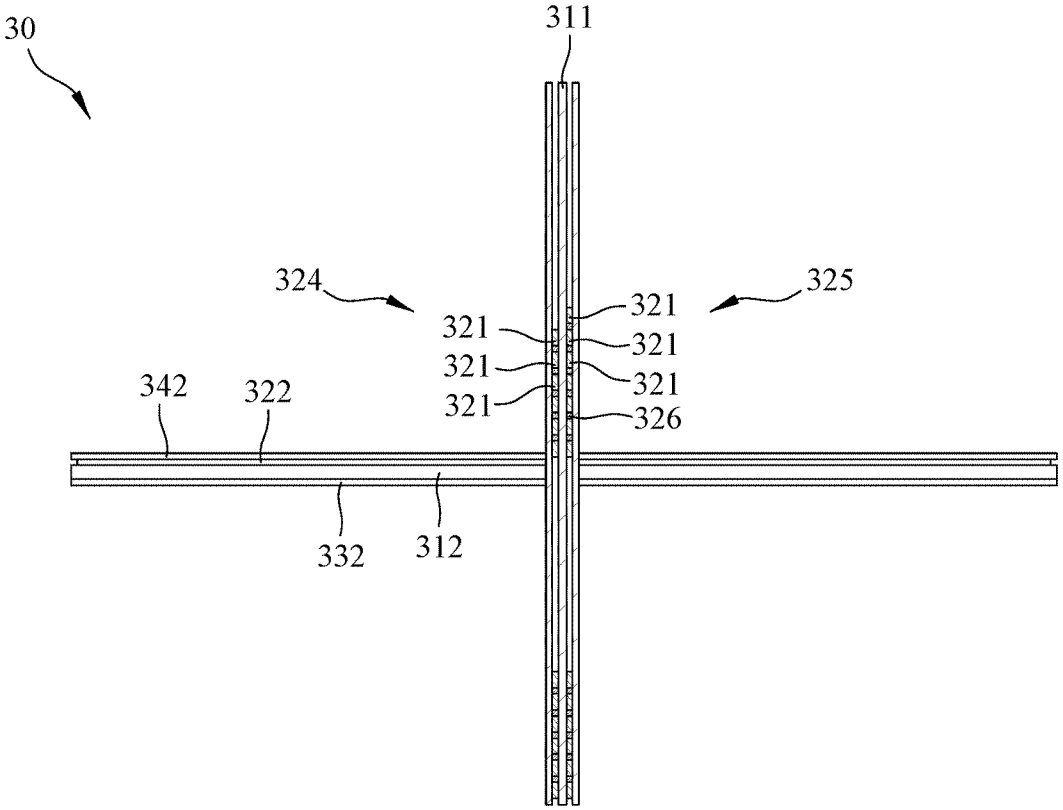
FIG. 10 is a cross-sectional view taken along line C-C of FIG. 6.
Figure 11:
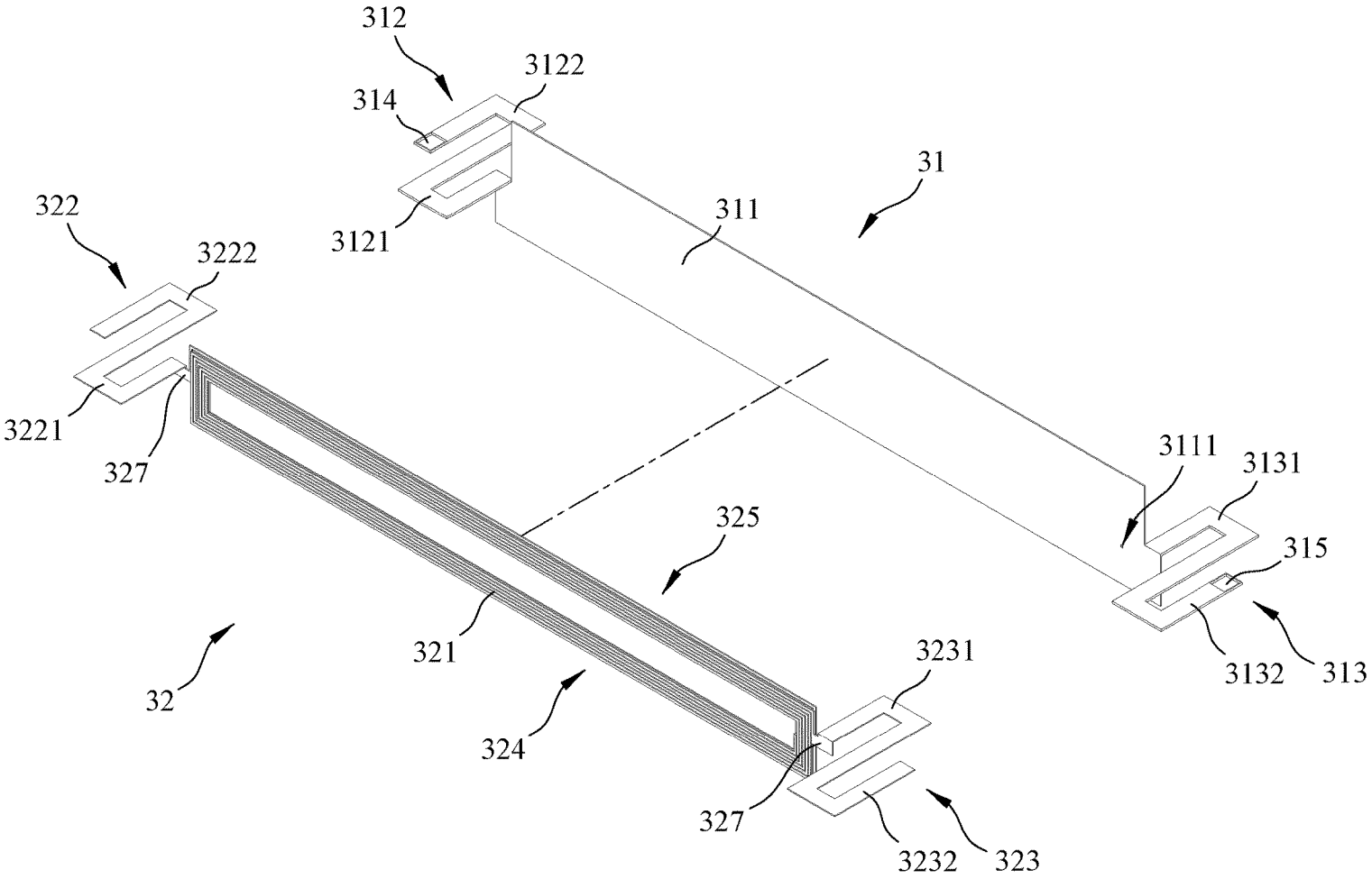
FIG. 11 is an exploded view of the holding member and conductive member of the damper voice coil of the present invention.
Figure 12:
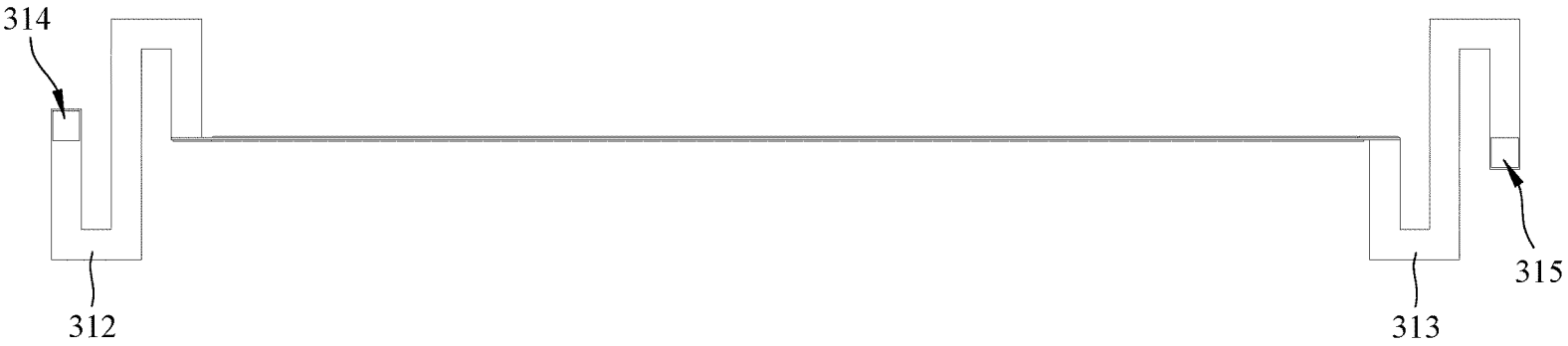
FIG. 12 is a top view of the holding member and conductive member of the damper voice coil of the present invention.
Figure 13:
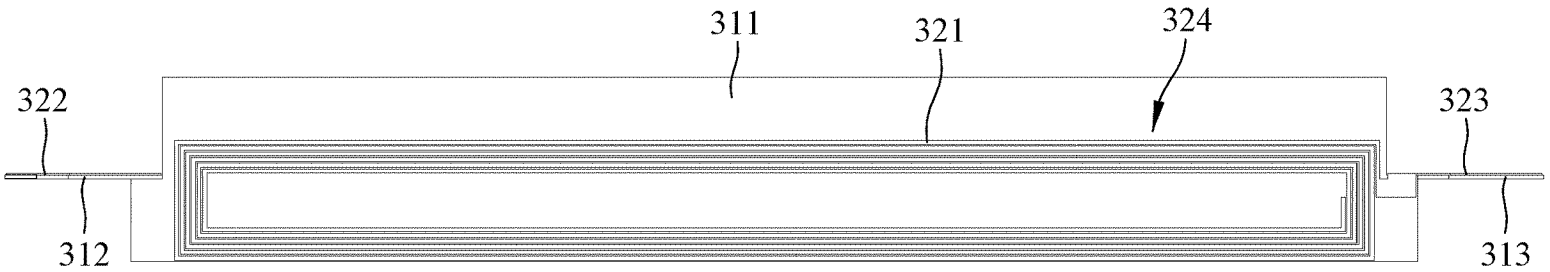
FIG. 13 is a front view of the holding member and conductive member of the damper voice coil of the present invention.

As shown in FIGS. 10 to 13, the holding base 311 is provided with a through hole 3111, the through hole 3111 penetrates from one side to the other side of the holding base 311, such that the conductor 321 passes through the through hole 3111 from one side of the holding base 311 and extends to the other side of the holding base 311. The conductor 321 is wound from the inside to the outside of the through hole 3111 to form the first winding 324 on one side of the holding base 311 and the second winding 325 on the other side of the holding base 311, thereby reducing the length of the route of the conductor 321 extending to the sides of the holding base 311. More specifically, as shown in FIGS. 11 and 13, the through hole 3111 is positioned adjacent to one end of the holding base 311 and located below the middle line of the holding base 311 in the longitudinal direction. The conductor 321 first extends downward at one side of the holing base 311, and then extends in the direction toward the other end of the holding base 311, extends upward, extends in the direction toward the one end of the holding base 311, and finally extends downward, and evades the opening of the through hole 3111 from one side of the through hole 3111, to form a complete lap of the conductor 321. Next, the next lap of the conductor 321 bypasses the former lap of the conductor 321 in the same manner. The conductor 321 first extends upward at the other side of the holing base 311, and then extends in the direction toward the other end of the holding base 311, extends downward, extends in the direction toward the one end of the holding base 311, and finally extends upward, and evades the opening of the through hole 3111 from one side of the through hole 3111, to form a complete lap of the conductor 321. Next, the next lap of the conductor 321 bypasses the former lap of the conductor 321 in the same manner. As shown in FIG. 10, by the above-mentioned winding manner, the first winding 324 has six laps of the conductor 321 and the second winding 325 has seven laps of the conductor 321. The positions and the winding routes of the six laps of the conductor 321 of the first winding 324 and the six inner laps of the conductor 321 of the second winding 325 are almost the same, the conductor 321 of the first winding 324 and the conductor 321 of the second winding 325 are only different in the part where they just pierce out from the through hole 3111 (one extends upward and one extends downward), and that the second winding 325 has an additional outer lap of the conductor 321.

More importantly, as shown in FIGS. 5 and 10, the cross-section of the conductor 321 is a rectangle, an insulation layer 326 is filled between two adjacent laps of the conductor 321 of the first winding 324, and an insulation layer 326 is filled between two adjacent laps of the conductor 321 of the second winding 325. As a result, since each lap of the conductor 321 contacts with the insulation layer 326 face by face without gaps, the conductor 321 has a greater conductor area and results in higher magnetic flux, thus having beneficial effects in effectively achieving sound effect output with high efficiency and low magnetic leakage. The optimal performance of the present invention is thereby improved.

Figure 7:
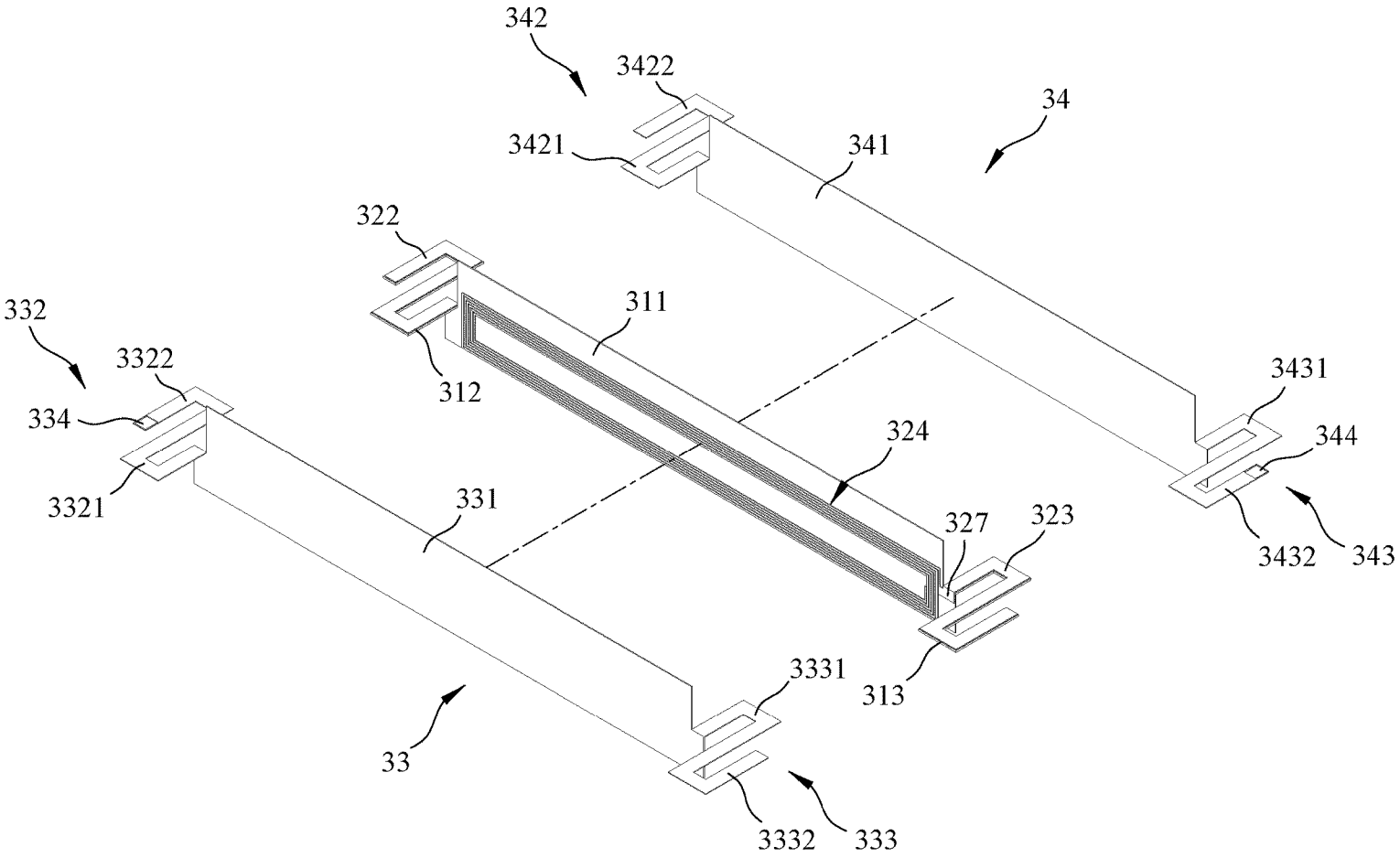
FIG. 7 is an exploded view of the damper voice coil of the present invention.
Figure 8:
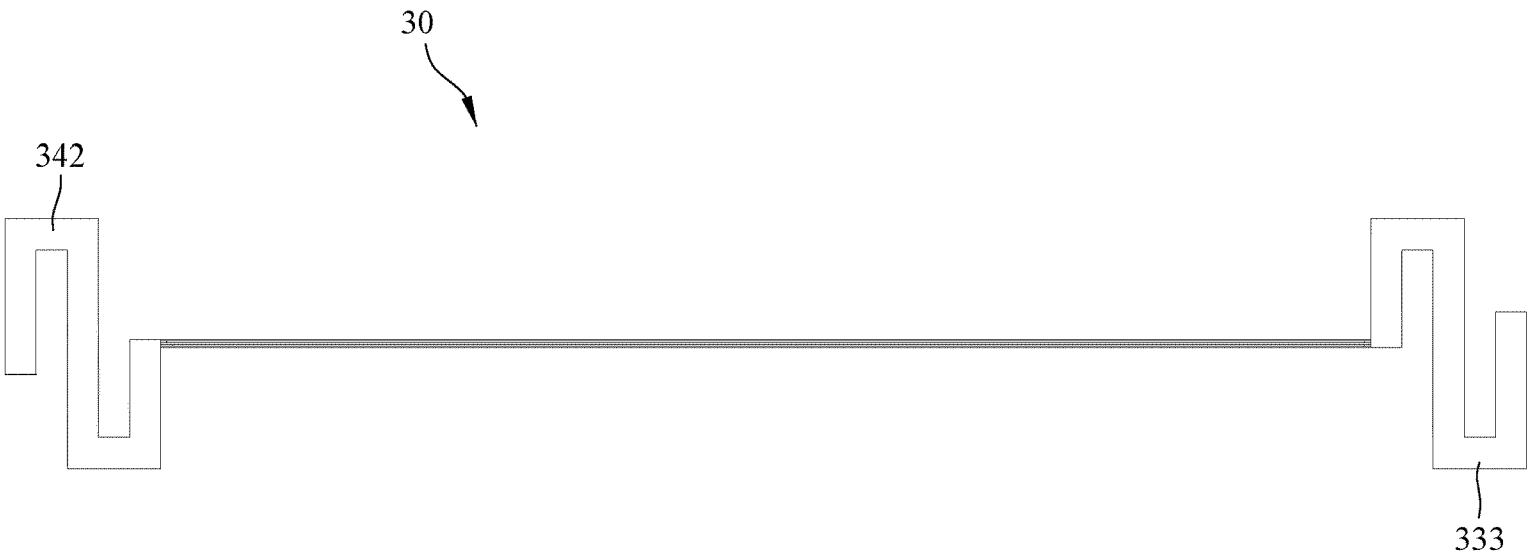
FIG. 8 is a top view of the damper voice coil of the present invention.
Figure 9:
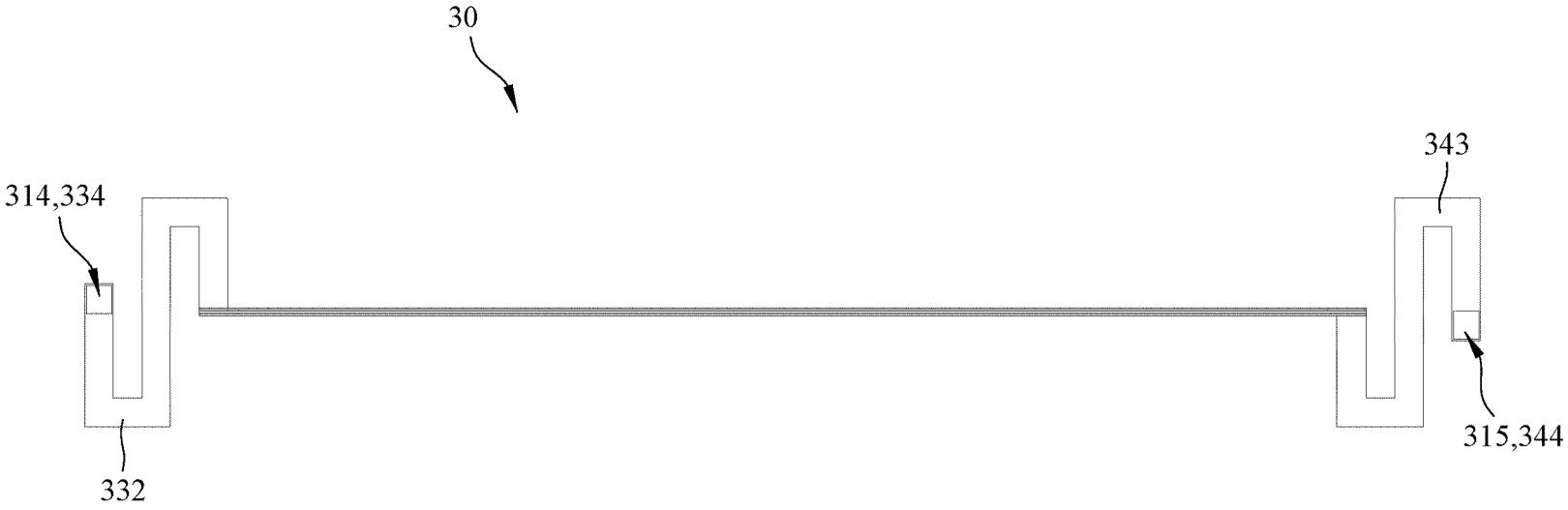
FIG. 9 is a bottom view of the damper voice coil of the present invention.

It should be noted that, as shown in FIGS. 7 and 11, the connection points between the two conductive suspension portions 322, 323 and the two ends of the conductor 321 are bent to become two positioning plates 327, which respectively abut against two sides of the holding base 311. Since the two positioning plates 327 are parallel to the conductor 321, the connection points between the two ends of the conductor 321 and the two positioning plates 327 are not required to be bent, thereby preventing the connection points between the two ends of the conductor 321 and the two positioning plates 327 become fractured.

As shown in FIGS. 3, 4 and 5, a plurality of protrusions protrude from inner side walls of the chamber 11 of the frame 10, the protrusions divides the chamber 11 into a primary room 111 and two suspension rooms 112, 113. The frame 10 is provided with two communication holes 110, each of which on one end of the frame 10. The conductive suspension portions 322, 323 pass through the communication holes 110 into the suspension rooms 112, 113, respectively. In the present embodiment, there are eight protrusions in total, which are defined as four pieces of compartment blocks 12, 13, 14, 15, and two pieces of magnet set positioning blocks 16, 17, and two pieces of suspension positioning blocks 18, 19. The four compartment blocks 12 to 15 are configured to protrude from the inner side walls at two sides of the chamber 11 of the frame 10, whereas the inner sides of the four compartment blocks 12 to 15 together surround to form the primary room 111. The end of each compartment blocks 12 to 15 that is away from the inner side wall of the chamber 11 of the frame 10 is bent toward the primary room 111 and extending to form a stop arm 121, 131, 141, 151. Two compartment blocks 12 and 13 that are at a same side further divide a portion of the primary room 111 into a first magnet set room 1111 via their stop arms 121 and 131, and two compartment blocks 14 and 15 that are at a same side further divide another portion of the primary room 111 into a second magnet set room 1112 via their stop arms 141 and 151. A first slit 120 is provided between the two stop arms 121 and 141 of the compartment blocks 12 and 14 that are at different sides but adjacent to each other, and a second slit 130 is provided between the two stop arms 131 and 151 of the compartment blocks 13 and 15 that are at different sides but adjacent to each other. One magnet set positioning block 16 is configured to protrude from the inner side wall of one side of the chamber 11 of the frame 10, near the bottom of the frame 10, and locate at the middle of the first magnet set room 1111. The other magnet set positioning block 17 is configured to protrude from the inner side wall of the other side of the chamber 11 of the frame 10, near the top of the frame 10, and locate at the middle of the second magnet set room 1112. The two suspension positioning blocks 18 and 19 are respectively configured to protrude from two diagonal corners of the inner side walls of the chamber 11 of the frame 10. The compartment blocks 12 and 14 and the suspension positioning block 18 together form the suspension room 112, and the other two compartment blocks 13 and 15 and the other suspension positioning block 19 together form the suspension room 113. The shape of the suspension rooms 112 and 113 are corresponding to the shape of the two holding suspension portions 312 and 313, respectively, and are also corresponding to the shape of the two conductive suspension portions 322 and 323, respectively. For thinning the structure of the damper voice coil 30, the magnetic device 20 can be designed to include only two magnet sets 21, which are disposed in the first magnet set room 1111 and the second magnet set room 1112 and are spaced apart with each other. Each of the magnet sets 21 includes a magnet 211 and two magnetic metals 212, the magnet 211 is disposed between the two magnetic metals 212. A combination of the holding base 311 and the conductor 321 is located at a gap 22 between the two magnet sets 21, and the two ends of the same are respectively located in the first slit 120 and the second slit 130. A combination of the holding suspension portion 312 and the conductive suspension portion 322 is disposed within the suspension room 112 and located at the bottom of the suspension positioning block 18. A combination of the other holding suspension portion 313 and the other conductive suspension portion 323 is disposed within the suspension room 113 and located at the bottom of the suspension positioning block 19.

Therefore, since the structure of the damper voice coil 30 is thinned, the magnetic device 20 can be designed to include only two magnet sets 21, and the frame 10 can be appropriately reduced in volume and length to accommodate the magnetic device 20 and the damper voice coil 30, reducing the volume and weight of the present invention, so as for the present invention to be in line with consumer's pursuit of thinner and smaller products.

Furthermore, the arrangement of the inner space of the frame 10 is carefully designed, allowing the magnetic device 20 and the damper voice coil 30 be properly positioned to facilitate their assembly.

As shown in FIGS. 6 to 10, the damper voice coil 30 includes a first clamping member 33 and a second clamping member 34. The first clamping member 33 includes a first clamping base 331 and two first clamping suspension portions 332, 333. The two first clamping suspension portions 332 and 333 are respectively integrally formed on two ends of the first clamping base 331. The second clamping member 34 includes a second clamping base 341 and two second clamping suspension portions 342, 343. The two second clamping suspension portions 342 and 343 are respectively integrally formed on two ends of the second clamping base 341. The first clamping base 331 and the second clamping base 341 together clamp a combination of the holding base 311 and the conductor 321. In other words, the first clamping base 331, the second clamping base 341, the holding base 311 and the conductor 321 together are located at the gap 22 between the two magnet sets 21, and two ends of the same are respectively located in the first slit 120 and the second slit 130

The two first clamping suspension portions 332 and 333 are respectively corresponding to the two holding suspension portions 312 and 313 in shape, and the two second clamping suspension portions 342 and 343 are respectively corresponding to the two holding suspension portions 312 and 313 in shape. The first clamping suspension portion 332 and the second clamping suspension portion 342 together clamp a combination of the holding suspension portion 312 and the conductive suspension portion 322, wherein the second clamping suspension portion 342 contacts the inner side wall of the chamber 11 of the frame 10. In other words, a combination of the first clamping suspension portion 332, the second clamping suspension portion 342, the holding suspension portion 312, and the conductive suspension portion 322 is disposed within the suspension room 112 and located at the bottom of the suspension positioning block 18. More specifically, as shown in FIGS. 4 and 7, the second clamping suspension portion 342 and the holding suspension portion 312 together clamp the conductive suspension portion 322, and the top of the second clamping suspension portion 342 abuts against the bottom of the suspension positioning block 18; the first clamping suspension portion 332 supports the holding suspension portion 312 and is provided with an opening hole 334. The opening hole 334 of the first clamping suspension portion 332 communicates with the perforation 314 of the holding suspension portion 312, such that at least a part of the conductive suspension portion 322 is exposed from the opening hole 334 of the first clamping suspension portion 332 and the perforation 314 of the holding suspension portion 312. One of the terminals passes through the opening hole 334 of the first clamping suspension portion 332 and the perforation 314 of the holding suspension portion 312, and connects to the conductive suspension portion 322. The other first clamping suspension portion 333 and the other second clamping suspension portion 343 together clamp a combination of the holding suspension portion 313 and the conductive suspension portion 323, wherein the first clamping suspension portion 333 contacts the inner side wall of the chamber 11 of the frame 10. In other words, a combination of the first clamping suspension portion 333, the second clamping suspension portion 343, the holding suspension portion 313, and the conductive suspension portion 323 is provided within the suspension room 113 and located at the bottom of the suspension positioning block 19. More specifically, as shown in FIGS. 4 and 7, the first clamping suspension portion 333 and the holding suspension portion 313 together clamp the conductive suspension portion 323, and the top of the first clamping suspension portion 333 abuts against the bottom of the suspension positioning block 19; the second clamping suspension portion 343 supports the holding suspension portion 313 and is provided with an opening hole 344. The opening hole 344 of the second clamping suspension portion 343 communicates with the perforation 315 of the holding suspension portion 313, such that at least a part of the conductive suspension portion 323 is exposed from the opening hole 344 of the second clamping suspension portion 343 and the perforation 315 of the holding suspension portion 313. The other terminal passes through the opening hole 344 of the second clamping suspension portion 343 and the perforation 315 of the holding suspension portion 313, and connects to the conductive suspension portion 323.

Therefore, the first clamping base 331 and the second clamping base 341 provides appropriate protection to the combination of the holding base 311 and the conductor 321, providing excellent positioning effects. The two first clamping suspension portions 332, 333 and the two second clamping suspension portions 342, 343 can be served as a damper, providing the following beneficial effects: first, holding the first clamping base 331 and the second clamping base 341 at a correct position within the magnetic device 20; second, assisting the two holding suspension portions 312, 313 to ensure the holding base 311 stably perform the vertical reciprocating motion to move up and down along the axial direction when force is applied; third, assisting the two holding suspension portions 312, 313 to determine the resonance frequency of the speaker together with the holding base 311 and the diaphragm 40; and fourth, fixing the two holding suspension portions 312, 313 and the two conductive suspension portions 322, 323. In overall, the structural strength of the damper voice coil 30 is improved, and the damper voice coil 30 is light in weight.

In order to render the beneficial effects mentioned above, the materials of the first clamping member 33 and the second clamping member 34 are preferably the same as the holding member 31, such as flexible printed circuit. However, materials different from the holding member 31 can also be used as the materials of the first clamping member 33 and the second clamping member 34.

In a preferred embodiment, the holding suspension portions 312 and 313 are provided with perforations 314 and 315, respectively, at their end; and an end of the first clamping suspension portion 332 is provided with the opening hole 334, and an end of the second clamping suspension portion 343 is provided with the opening hole 344. Since the perforations 314, 315 are located at end of the holding suspension portions 312, 313, the two opening holes 334 and 344 are located at end of the first clamping suspension portion 332 and end of the second clamping suspension portion 343, respectively, such that the two terminals is capable of immediately connecting to the two conductive suspension portions 322, 323 after they pass through the two communication holes 110, to reduce the length of the terminals extending in the chamber 11.

In the preferred embodiment, as shown in FIG. 11, the two holding suspension portions 312, 313 have a same shape and are perpendicular to the holding base 311. In particular, each of the holding suspension portions 312, 313 has a first U-shaped segment 3121, 3131 and a second U-shaped segment 3122, 3132. The first U-shaped segment 3121 of the holding suspension portion 312 and the first U-shaped segment 3131 of the holding suspension portion 313 are integrally formed on two different ends of the holding base 311, respectively, and are located at two different sides of the holding base 311, respectively. The second U-shaped segment 3122 of the holding suspension portion 312 and the second U-shaped segment 3132 of the holding suspension portion 313 are integrally formed on other end of the first U-shaped segment 3121 of the holding suspension portion 312 and other end of the first U-shaped segment 3131 of the holding suspension portion 313, respectively, and are located at two different sides of the holding base 311, respectively. The first U-shaped segment 3121, 3131 and the second U-shaped segment 3122, 3132 of each of the holding suspension portions 312, 313 are located at two different sides of the holding base 311 and are opened in opposite directions. In other words, the shape of the two holding suspension portions 312, 313 is similar to a mirror image of the number "5".

As shown in FIG. 11, each of the conductive suspension portions 322, 323 has a first U-shaped segment 3221, 3231 and a second U-shaped segment 3222, 3232. The first U-shaped segment 3221 of the conductive suspension portion 322 and the first U-shaped segment 3231 of the conductive suspension portion 323 are integrally formed on two different ends of the conductor 321, respectively and are located at an external side of the first winding 324 and an external side of the second winding 325, respectively. The second U-shaped segment 3222 of the conductive suspension portion 322 and the second U-shaped segment 3232 of the conductive suspension portion 323 are integrally formed on other end of the first U-shaped segment 3221 of the conductive suspension portion 322 and other end of the first U-shaped segment 3231 of the conductive suspension portion 323, respectively, and are located at the external side of the second winding 325 and the external side of the first winding 324, respectively. The first U-shaped segment 3221 and the second U-shaped segment 3222 of the conductive suspension portion 322 are located at the external side of the first winding 324 and the external side of the second winding 325, respectively; the first U-shaped segment 3231 and the second U-shaped segment 3232 of the conductive suspension portion 323 are located at the external side of the second winding 325 and the external side of the first winding 324, respectively; and the first U-shaped segment 3221, 3231 and the second U-shaped segment 3222, 3232 are opened in opposite directions. In other words, the shape of the conductive suspension portions 322, 323 is similar to a mirror image of the number "5".

Figure 6:
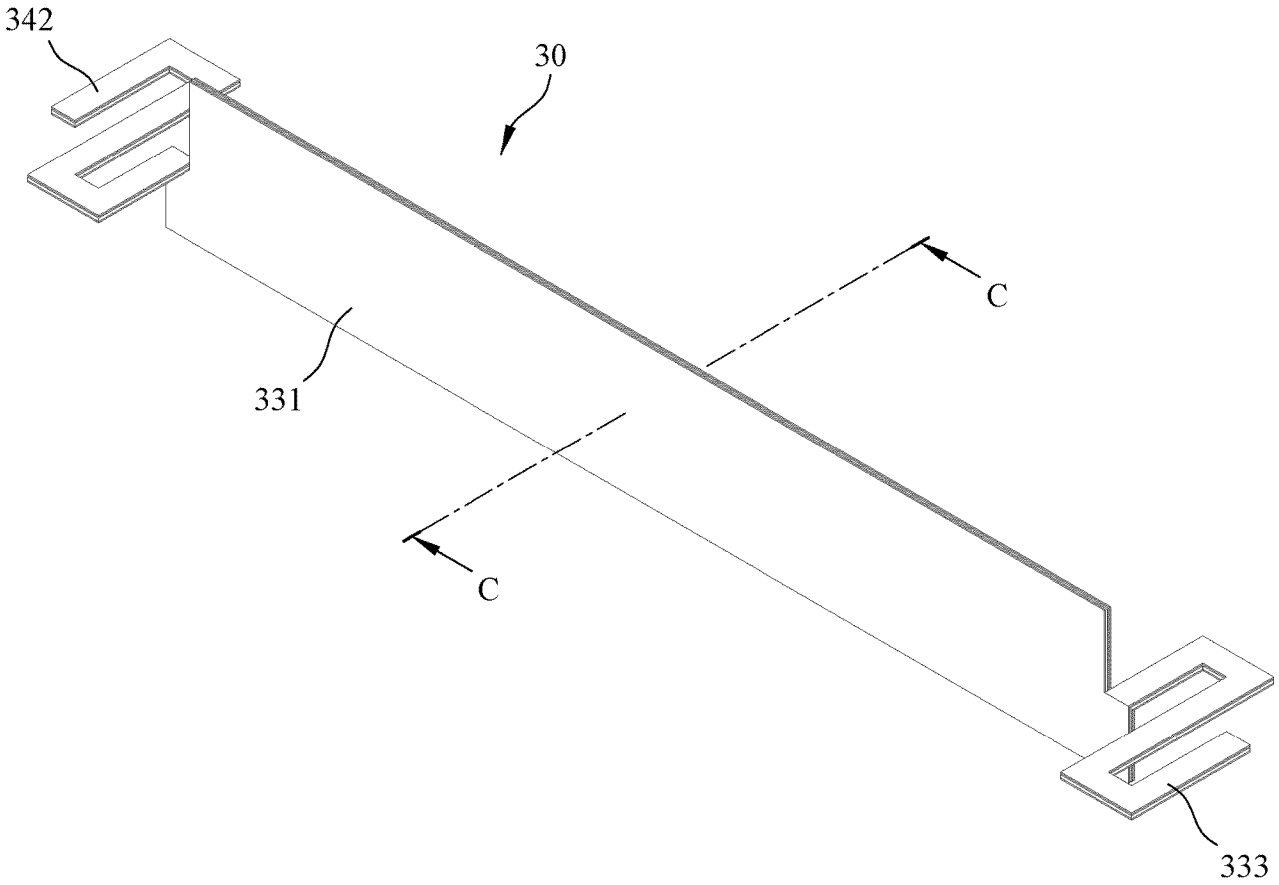
FIG. 6 is a perspective view of the damper voice coil of the present invention.

As shown in FIGS. 6 and 7, the first clamping suspension portions 332 and 333 are the same in shape and are perpendicular to the first clamping base 331. More specifically, each of the first clamping suspension portions 332, 333 has a first U-shaped segment 3321, 3331 and a second U-shaped segment 3322, 3332. The first U-shaped segment 3321 of the first clamping suspension portion 332 and the first U-shaped segment 3331 of the first clamping suspension portion 333 are integrally formed on two different ends of the first clamping base 331, respectively, and are located at two different sides of the first clamping base 331, respectively. The second U-shaped segment 3322 of the first clamping suspension portion 332 and the second U-shaped segment 3332 of the first clamping suspension portion 333 are integrally formed on other end of the first U-shaped segment 3321 of the first clamping suspension portion 332 and other end of the first U-shaped segment 3331 of the first clamping suspension portion 333, respectively, and are located at two different sides of the first clamping base 331, respectively. The first U-shaped segment 3321, 3331 and the second U-shaped segment 3322, 3332 of each of the first clamping suspension portions 332, 333 are located at two different sides of the first clamping base 331 and opened in opposite directions. In other words, the shape of the first clamping suspension portions 332, 333 is similar to a mirror image of the number "5".

As shown in FIGS. 6 and 7, the second clamping suspension portions 342 and 343 are the same in shape and are perpendicular to the second clamping base 341. More specifically, each of the second clamping suspension portions 342, 343 has a first U-shaped segment 3421, 3431 and a second U-shaped segment 3422, 3432. The first U-shaped segment 3421 of the second clamping suspension portion 342 and the first U-shaped segment 3431 of the second clamping suspension portion 343 are integrally formed on two different ends of the second clamping base 341, respectively, and are located at two different sides of the second clamping base 341, respectively. The second U-shaped segment 3422 of the second clamping suspension portion 342 and the second U-shaped segment 3432 of the second clamping suspension portion 343 are integrally formed on other end of the first U-shaped segment 3421 of the second clamping suspension portion 342 and other end of the first U-shaped segment 3431 of the second clamping suspension portion 343, respectively, and are located at two different sides of the second clamping base 341, respectively. The first U-shaped segment 3421, 3431 and the second U-shaped segment 3422, 3432 of each of the second clamping suspension portions 342, 343 are located at two different sides of the second clamping base 341 and opened in opposite directions. In other words, the shape of the second clamping suspension portions 342, 343 is similar to a mirror image of the number "5".

However, the shape of the two holding suspension portions 312, 313, the two conductive suspension portions 322, 323, the two first clamping suspension portions 332, 333, and the two second clamping suspension portions 342, 343 illustrated above is only an exemplary embodiment, the shape thereof is not limited hereto.

Figure 14:
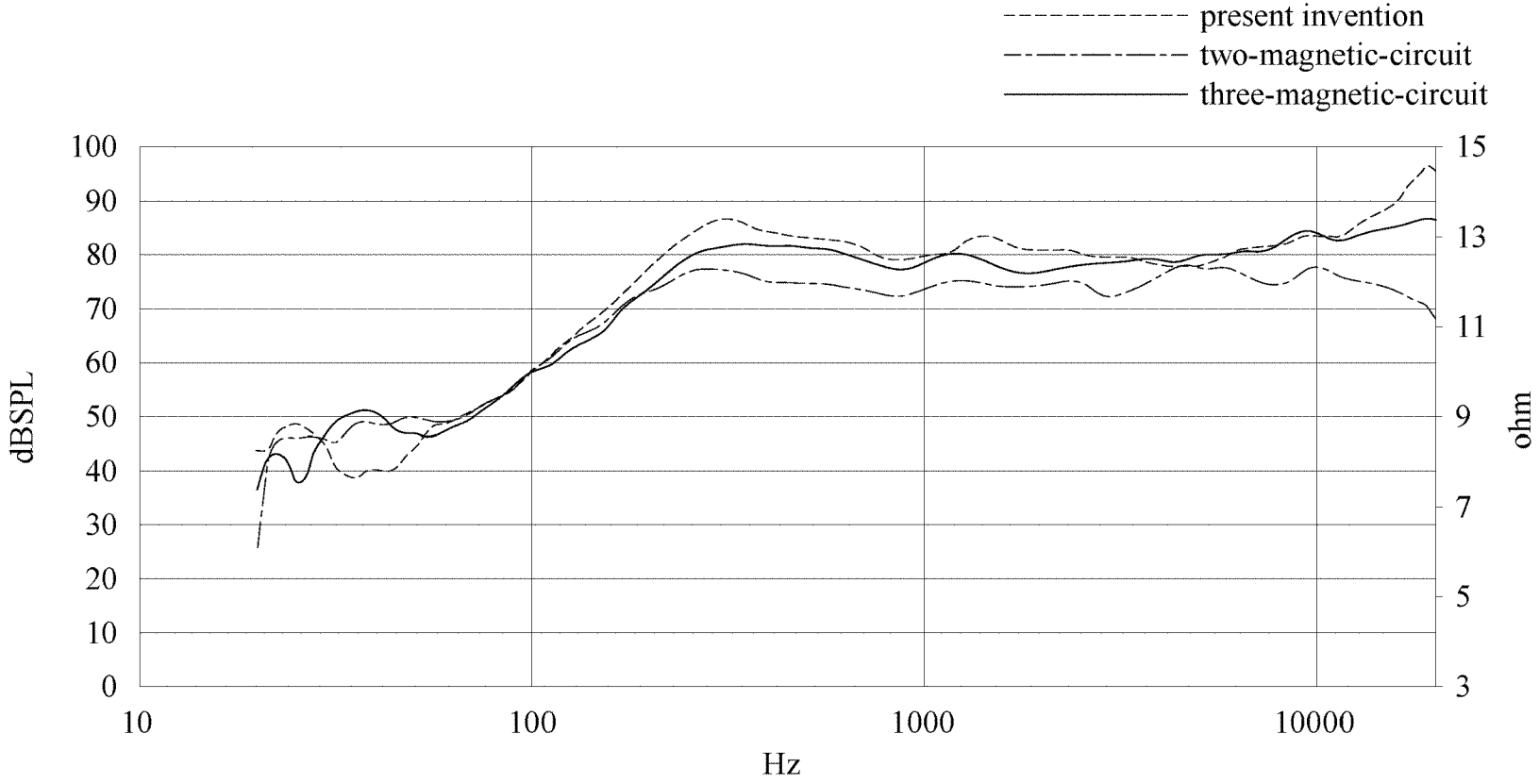
FIG. 14 is a chart comparing the characteristics of frequency response curves of the present invention and the prior arts.

Referring to FIG. 14, which is a chart comparing the characteristics of frequency response curves of the present invention and the prior arts. The y-axis at the left side represents sound pressure level (SPL) by units of decibel (dB), the y-axis at the right side represents impedance by units of ohm, and the x-axis represents frequency by units of hertz (Hz). As shown in FIG. 14, the present invention is compared with a conventional two-magnetic-circuit speaker and a conventional three-magnetic-circuit speaker in a same dimension, to illustrate their differences in characteristics of frequency response curves.

First, the present invention is compared with the conventional two-magnetic-circuit speaker and three-magnetic-circuit speaker for the high frequency (10,000 Hz to 20,000 Hz) performance. The conventional two-magnetic-circuit speaker is suddenly reduced from approximately 78 dB to approximately 68 dB, with reducing amplitude of about 10 dB. The conventional three-magnetic-circuit speaker is slightly increased from approximately 82 dB to approximately 86 dB, with increasing amplitude of about 4 dB. The present invention is suddenly increased from approximately 82 dB to approximately 95 dB, with increasing amplitude of about 13 dB.

From the comparison result shown above, for high frequency performance, the present invention has the greatest increasing amplitude of sound pressure level which exceeds the increasing amplitude of sound pressure level of the conventional three-magnetic-circuit speaker by at least 9 dB; thus, the present invention has the best performance among the three for high frequency performance. The increasing amplitude of sound pressure level for high frequency performance in the conventional three-magnetic-circuit speaker is between the present invention and the conventional two-magnetic-circuit speaker; thus, the conventional three-magnetic-circuit speaker has the second-best performance among the three for high frequency performance. The sound pressure level for high frequency performance in the conventional two-magnetic-circuit speaker is reduced; thus, the conventional two-magnetic-circuit speaker has the poorest performance among the three for high frequency performance.

Therefore, comparing with the conventional two-magnetic-circuit speaker and the conventional three-magnetic-circuit speaker, the high frequency performance of the present invention has excellent ductility, the low frequency performance thereof is maintained at a standard level, and the efficiency of sound pressure level thereof is the highest among the three; thus, the present invention can be used as a full-range speaker, or simply as a high frequency speaker.

Figure 15:
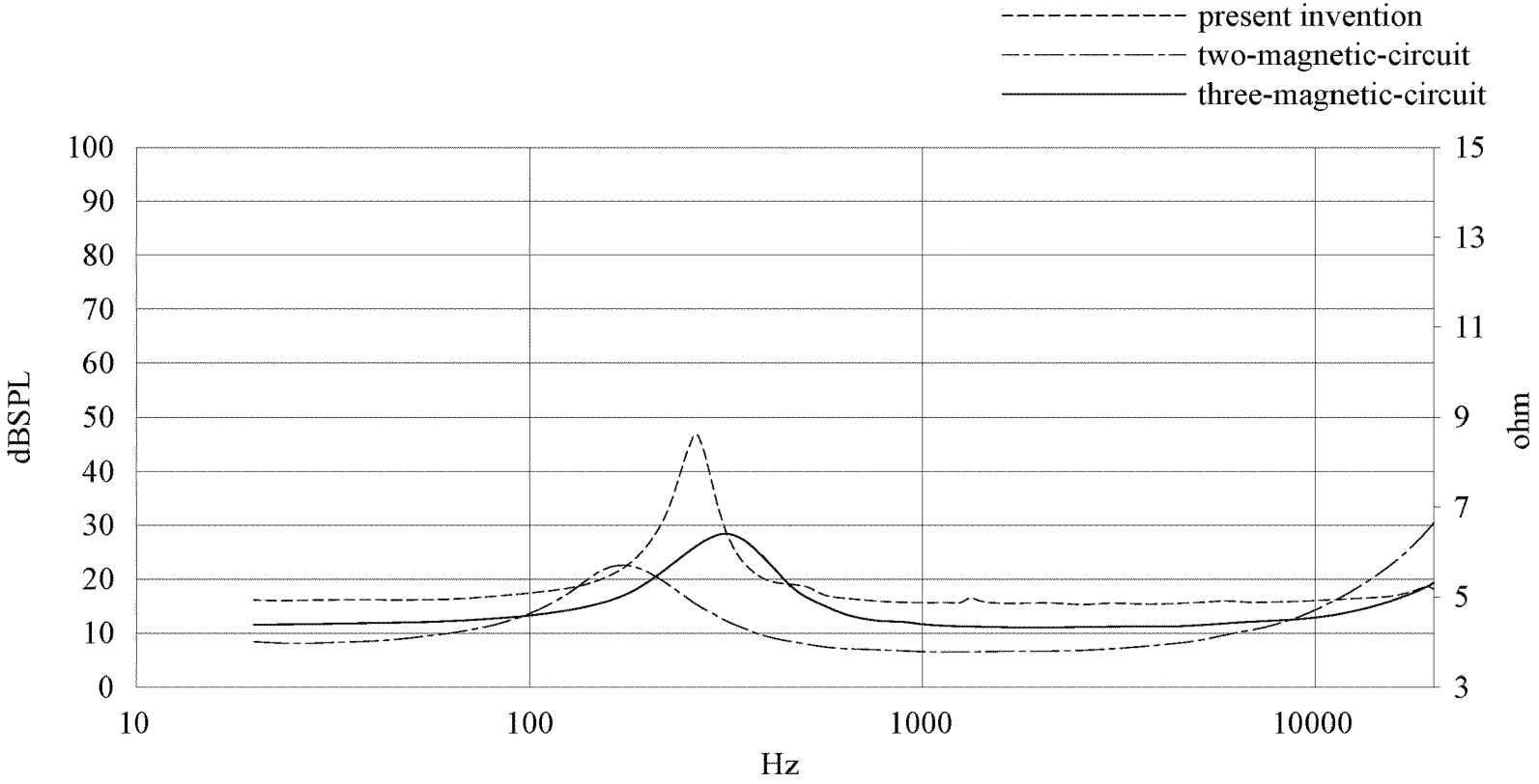
FIG. 15 is a chart comparing the characteristics of impedance curves of the present invention and the prior arts.

Referring to FIG. 15, which is a chart comparing the characteristics of impedance curves of the present invention and the prior arts. The y-axis at the left side represents sound pressure level (SPL) by units of decibel (dB), the y-axis at the right side represents impedance by units of ohm, and the x-axis represents frequency by units of hertz (Hz). As shown in FIG. 15, the present invention is compared with the conventional two-magnetic-circuit speaker and three-magnetic-circuit speaker in a same dimension, to illustrate their differences in characteristics of impedance curves.

First, the present invention is compared with the conventional two-magnetic-circuit speaker and the conventional three-magnetic-circuit speaker for the impedance performance in high frequency (10,000 Hz to 20,000 Hz). The impedance value of the conventional two-magnetic-circuit speaker is suddenly increased from approximately 4.7 ohm to approximately 6.5 ohm, with increasing amplitude of about 1.8 ohm. The impedance value of the conventional three-magnetic-circuit speaker is slightly increased from approximately 4.5 ohm to approximately 5.3 ohm, with increasing amplitude of about 0.8 ohm. The impedance value of the present invention is slightly increased from approximately 5 ohm to approximately 5.2 ohm, with increasing amplitude of about 0.2 ohm.

The increasing amplitude of impedance of the voice coil represents its inductive reactance level. From the comparison result shown above, the present invention has the smallest increasing amplitude of impedance for high frequency performance and has the flattest curve, meaning that the inductive reactance level of the damper voice coil 30 of the present invention is the lowest, which is one of the reasons that the sound pressure level of the present invention for high frequency performance is suddenly increased. The increasing amplitude of impedance for high frequency performance of the conventional three-magnetic-circuit speaker is between the present invention and the conventional two-magnetic-circuit speaker, meaning that the inductive reactance level of the voice coil of the conventional three-magnetic-circuit speaker is between the damper voice coil 30 of the present invention and the voice coil of the conventional two-magnetic-circuit speaker, which is one of the reasons that the sound pressure level of the conventional three-magnetic-circuit speaker for high frequency performance is slightly increased. The conventional two-magnetic-circuit speaker has the greatest increasing amplitude of impedance for high frequency performance and has the steepest curve, meaning that the inductive reactance level of the conventional two-magnetic-circuit speaker is the highest, which is one of the reasons that the sound pressure level of the conventional two-magnetic-circuit speaker for high frequency performance is suddenly reduced.

Second, the present invention is compared with the conventional two-magnetic-circuit speaker and the conventional three-magnetic-circuit speaker for the impedance performance in low frequency (100 Hz to 1,000 Hz). The lower the value of the peak of frequency suggests the better ductility at low frequency. The peak value of the present invention is in between the conventional two-magnetic-circuit speaker and the conventional three-magnetic-circuit speaker. A desired peak value of frequency can be reached by adjusting the structure of the suspension system (i.e. the combination of the two holding suspension portions 312, 313, the two conductive suspension portions 322, 323, the two first clamping suspension portions 332, 333, and the two second clamping suspension portions 342, 343, and edges) of the present invention while keeping a balance between power rating and distortion rate.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A thin speaker with a voice coil having a damper function, comprising:

a frame configured to surround and define a chamber;

a magnetic device disposed inside the chamber;

a damper voice coil disposed inside the chamber, the damper voice coil comprising a holding member and a conductive member, the holding member including a holding base and two holding suspension portions, the holding base disposed inside the magnetic device, the two holding suspension portions respectively integrally formed on two ends of the holding base, each of the holding suspension portions provided with a perforation, the conductive member including a conductor and two conductive suspension portions, the conductor wound to form a first winding at one side of the holding base and a second winding at the other side of the holding base, the two conductive suspension portions respectively integrally formed on two ends of the conductor, the conductive suspension portions located on a top of the holding suspension portions, the shape of the conductive suspension portions corresponding to the shape of the holding suspension portions, and at least a part of each of the conductive suspension portions exposed from the perforations of the holding suspension portions; and a diaphragm disposed on a top of the damper voice coil, and a bottom of the diaphragm abutting against the top of the damper voice coil.

2. The thin speaker according to claim 1, wherein the damper voice coil comprises a first clamping member and a second clamping member; the first clamping member includes a first clamping base and two first clamping suspension portions, the two first clamping suspension portions are respectively integrally formed on two ends of the first clamping base; the second clamping member includes a second clamping base and two second clamping suspension portions, the two second clamping suspension portions are respectively integrally formed on two ends of the second clamping base; the first clamping base and the second clamping base together clamp a combination of the holding base and the conductor;

the first clamping suspension portions are corresponding to the holding suspension portions in shape, and the second clamping suspension portions are corresponding to the holding suspension portions in shape; one of the first clamping suspension portions and one of the second clamping suspension portions together clamp a combination of one of the holding suspension portions and one of the conductive suspension portions, wherein said one of the second clamping suspension portions contacts an inner side wall of the chamber of the frame;

the other one of the first clamping suspension portions and the other one of the second clamping suspension portions together clamp a combination of the other one of the holding suspension portions and the other one of the conductive suspension portions, wherein said other one of first clamping suspension portions contacts the inner side wall of the chamber of the frame;

said one of the first clamping suspension portions is provided with an opening hole which is communicated with the perforation of said one of the holding suspension portions, such that at least a part of said one of the conductive suspension portions is exposed from the opening hole of said one of the first clamping suspension portions and the perforation of said one of the holding suspension portions; and said other one of the second clamping suspension portions is provided with an opening hole which is communicated with the perforation of said other one of the holding suspension portions, such that at least a part of said other one of the conductive suspension portions is exposed from the opening hole of said other one of the second clamping suspension portions and the perforation of said other one of the holding suspension portions.

3. The thin speaker according to claim 2, wherein the two holding suspension portions have a same shape and are perpendicular to the holding base, the two first clamping suspension portions have a same shape and are perpendicular to the first clamping base, and the two second clamping suspension portions have a same shape and are perpendicular to the second clamping base.

4. The thin speaker according to claim 3, wherein each of the holding suspension portions has a first U-shaped segment and a second U-shaped segment; the two first U-shaped segments of the holding suspension portions are respectively integrally formed on two ends of the holding base, and are respectively located at two sides of the holding base; the two second U-shaped segments of the holding suspension portions are respectively integrally formed on two other ends of the first U-shaped segments of the holding suspension portions, and are respectively located at two sides of the holding base; and the first U-shaped segment and the second U-shaped segment of each of the holding suspension portions are located at two different sides of the holding base and are opened in opposite directions;

wherein, each of the conductive suspension portions has a first U-shaped segment and a second U-shaped segment; the two first U-shaped segments of the conductive suspension portions are respectively integrally formed on two ends of the conductor, and are respectively located at an external side of the first winding and an external side of the second winding; the two second U-shaped segments of the conductive suspension portions are respectively integrally formed on two other ends of the first U-shaped segments of the conductive suspension portions, and are respectively located at the external side of the first winding and the external side of the second winding; the first U-shaped segment and the second U-shaped segment of said one of the conductive suspension portions are respectively located at the external side of the first winding and the external side of the second winding, the first U-shaped segment and the second U-shaped segment of said other one of the conductive suspension portions are respectively located at the external side of the second winding and the external side of the first winding; and the first U-shaped segment and the second U-shaped segment of each of the conductive suspension portions are opened in opposite directions;

wherein, each of the first clamping suspension portions has a first U-shaped segment and a second U-shaped segment; the two first U-shaped segments of the first clamping suspension portions are respectively integrally formed on two ends of the first clamping base, and are respectively located at two sides of the first clamping base; the two second U-shaped segments of the first clamping suspension portions are respectively integrally formed on two other ends of the first U-shaped segments of the first clamping suspension portions, and are respectively located at two sides of the first clamping base; and the first U-shaped segment and the second U-shaped segment of each of the first clamping suspension portions are located at two different sides of the first clamping base and are opened in opposite directions; and wherein, each of the second clamping suspension portions has a first U-shaped segment and a second U-shaped segment; the two first U-shaped segments of the second clamping suspension portions are respectively integrally formed on two ends of the second clamping base, and are respectively located at two sides of the second clamping base; the two second U-shaped segments of the second clamping suspension portions are respectively integrally formed on two other ends of the first U-shaped segments of the second clamping suspension portions, and are respectively located at two sides of the second clamping base; and the first U-shaped segment and the second U-shaped segment of each of the second clamping suspension portions are respectively located at two different sides of the second clamping base and are opened in opposite directions.

5. The thin speaker according to claim 2, wherein each of the holding suspension portions is provided with the perforation at one end; said one of the first clamping suspension portions is provided with the opening hole at one end, and said other one of the second clamping suspension portions is provided with the opening hole at one end.

6. The thin speaker according to claim 2, wherein the holding member, the first clamping member and the second clamping member are flexible printed circuits; and the conductor is printed and wound on two sides of the holding base to form the first winding and the second winding.

7. The thin speaker according to claim 1, wherein the holding base is provided with a through hole, the through hole penetrates from one side of the holding base to the other side of the holding base; and the conductor passes through the through hole from one side of the holding base and extends to the other side of the holding base, the conductor is wound from inside to outside of the through hole to form the first winding on one side of the holding base and the second winding on the other side of the holding base.

8. The thin speaker according to claim 7, wherein connection points between the two conductive suspension portions and two ends of the conductor are bent to become two positioning plates, the positioning plates respectively abut against two sides of the holding base.

9. The thin speaker according to claim 1, wherein the magnetic device includes two magnet sets, the magnet sets are spaced apart with each other, each of the magnet sets includes a magnet and two magnetic metals, the magnet is disposed between the two magnetic metals, and the damper voice coil is located at a gap between the two magnet sets.

10. The thin speaker according to claim 1, wherein the conductor has a rectangular cross-section; and an insulation layer is filled between two adjacent laps of the conductor of the first winding, and an insulation layer is filled between two adjacent laps of the conductor of the second winding.

* * * * *